US006773304B2

(12) United States Patent
Conway et al.

(10) Patent No.: US 6,773,304 B2
(45) Date of Patent: Aug. 10, 2004

(54) TAMPER RESISTANT PIN CONNECTION

(75) Inventors: Christopher J. Conway, Wilmot, NH (US); Fred Rogers, Enfield Center, NH (US); Darrin H. MacKenzie, Windsor, VT (US); Douglass A. Demers, Grantham, NH (US)

(73) Assignee: Thermal Dynamics Corporation, West Lebanon, NH (US)

( * ) Notice: Subject to any disclaimer, the term of this patent is extended or adjusted under 35 U.S.C. 154(b) by 0 days.

(21) Appl. No.: 10/014,384

(22) Filed: Nov. 9, 2001

(65) Prior Publication Data

US 2003/0092318 A1 May 15, 2003

(51) Int. Cl.[7] ..... H01R 13/40
(52) U.S. Cl. ..... 439/595
(58) Field of Search ..... 439/595

(56) References Cited

U.S. PATENT DOCUMENTS

| | | | | |
|---|---|---|---|---|
| 3,571,784 A | | 3/1971 | Naus et al. | |
| 3,648,213 A | | 3/1972 | Kobler | |
| 3,838,382 A | | 9/1974 | Sugar | |
| 4,013,331 A | | 3/1977 | Kobler | |
| 4,019,799 A | | 4/1977 | Bouvier | |
| 4,082,398 A | | 4/1978 | Bourdon et al. | |
| 4,221,446 A | | 9/1980 | Niles et al. | |
| 4,358,179 A | | 11/1982 | Bourdon et al. | |
| 4,374,604 A | | 2/1983 | Hemmer et al. | |
| 4,406,507 A | * | 9/1983 | Eifler | 439/595 |
| 4,421,378 A | | 12/1983 | Sanford et al. | |
| 4,636,020 A | | 1/1987 | Marmillion | |
| 4,639,061 A | | 1/1987 | Muzslay | |
| 4,660,803 A | | 4/1987 | Johnston et al. | |
| 4,676,572 A | | 6/1987 | Booker | |
| 4,749,373 A | | 6/1988 | Brekosky et al. | |
| 4,752,251 A | | 6/1988 | Kato et al. | |
| 4,753,458 A | | 6/1988 | Case et al. | |
| 5,161,834 A | | 11/1992 | Norkey | |
| 5,591,049 A | | 1/1997 | Dohnishi | |
| 5,820,409 A | * | 10/1998 | Clark et al. | 439/595 |
| 5,988,705 A | | 11/1999 | Norkey | |

* cited by examiner

*Primary Examiner*—Renee Luebke
*Assistant Examiner*—Ann McCamey
(74) *Attorney, Agent, or Firm*—Harness, Dickey & Pierce, P.L.C.

(57) ABSTRACT

A tamper resistant pin connection for use in a plasma arc cutting apparatus is provided that comprises a plurality of locking fingers within a hollow internal channel of a housing that secure a negative lead gas carrying pin within the housing. The pin comprises a first collar with a shoulder disposed thereon, and accordingly, the locking fingers engage the shoulder to secure the pin within the housing. The pin further comprises a second collar that blocks access to the locking fingers through a first portion of the hollow internal channel such that the locking fingers cannot be accessed to disengage the pin. Further, the pin is recessed within a second portion of the hollow internal channel to prevent further access to the pin for a tamper resistant pin connection.

23 Claims, 6 Drawing Sheets

18

VIEW B

TAMPER RESISTANT PIN CONNECTION

FIELD OF THE INVENTION

The present invention relates generally to mechanical connectors and more particularly to mechanical connectors that secure two members together such that the connection is tamper resistant. More specifically, the present invention relates to tamper resistant fluid and electric connectors for use in plasma arc torches.

BACKGROUND OF THE INVENTION

A manually operated plasma arc cutting torch typically comprises a power supply that supplies fluid (e.g., gas, liquid) flow and electric current to a torch head through a torch lead. The torch lead is often removably connected to the power supply such that a variety of power supplies may be used with a single torch head and torch lead combination, and vice versa. At the connection between the power supply and the torch lead, at least one negative lead or pin, which may also carry fluid, or cutting gas, is connected to the torch lead side of the connection. Typically, the pin is disposed within a housing to insulate and seal the fluid flow and electric current traveling through the pin. Additionally, a main power socket is connected to the power supply side of the connection, which is similarly disposed within a housing, along with additional electrical connections for operation of the torch. Accordingly, the negative lead is inserted within the main power socket when connecting the torch lead to the power supply.

In power supplies of the known art, the negative lead is often designed to be field-replaceable such that as the negative lead wears during service due to both high voltages during operation and frictional wear when connecting and disconnecting the torch lead, the negative lead can be easily replaced in the field. Unfortunately, the replaceability of the negative lead often results in users installing an improper negative lead such that unsuitable equipment, e.g. torches, are mistakenly connected to the power supply. As a result, the torch may function improperly or parts may wear prematurely.

In power supplies that do not have a field-replaceable negative lead, the negative lead can be installed in a variety of ways. For example, the negative lead may be co-processed with the housing in an injection molding process, threaded into the housing, or the negative lead may be bonded or otherwise secured within a two-piece housing body, which allows access for assembly and/or disassembly. However, the installation of a negative lead that is not field-replaceable into housings of known art plasma arc power supplies is relatively time consuming and adds further cost to the torch and torch lead.

Accordingly, there remains a need in the art for a connector that provides a tamper resistant connection between a negative lead of a torch lead and a main power socket of a power supply in a plasma arc cutting apparatus. A further need exists for a tamper resistant connector that is capable of connecting both fluid, (e.g., gas, liquid), as well as electric conductors, yet which is relatively simple to install and relatively low cost.

SUMMARY OF THE INVENTION

In one preferred form, the present invention provides a connector for use in a plasma arc cutting apparatus comprising a housing defining a hollow internal channel, wherein at least one locking finger is disposed that engages a pin to secure the pin within the housing. Accordingly, the pin defines a first collar with a shoulder disposed thereon such that the locking finger engages the shoulder to secure the pin within the housing. Additionally, the hollow internal channel further comprises a first portion and the pin further defines a second collar such that the second collar blocks access to the locking finger through the first portion of the hollow internal channel. As a result, the locking finger cannot be accessed to disengage the pin as the second collar engages the first portion of the hollow internal channel. Furthermore, the pin is recessed within a second portion of the hollow internal channel when the locking finger fully engages the shoulder, thereby restricting access to the pin such that the connection remains tamper resistant.

Preferably, the pin is a negative lead gas carrying pin, and the housing is a plug housing that is secured to a torch lead side of a quick disconnect connector between the power supply and a torch lead in a plasma arc cutting apparatus. Accordingly, the negative lead gas carrying pin is secured within the connector of the torch lead side such that the connection is tamper resistant, thus preventing users from replacing damaged or worn pins with improper pins into the connector of the plasma arc cutting apparatus.

In another preferred form, the present invention provides a housing for use in connecting a pin in a plasma arc cutting apparatus that similarly comprises a hollow internal channel and at least one locking finger disposed within the hollow internal channel that engages the pin, which is inserted into the hollow internal channel, to secure the pin within the housing such that the connection is tamper resistant. Preferably, the locking finger is integrally formed within the hollow internal channel, as a part of the housing, and the pin slidably engages a first portion of the hollow internal channel such that the locking finger cannot be accessed to disengage the pin. Additionally, the pin is recessed within a second portion of the hollow internal channel to further restrict access to the pin and thus providing a tamper resistant pin connection.

In yet another preferred form of the present invention, a pin for use in a plasma arc cutting apparatus is provided that comprises a first collar and a shoulder disposed thereon, wherein the shoulder is engaged by a connecting member to secure the pin within the connecting member such that the connection is tamper resistant. Additionally, the pin may further comprise a second collar that blocks access to the shoulder such that the pin may not be disengaged from the connecting member.

As used herein, a plasma arc apparatus shall be construed by those skilled in the art to be an apparatus, whether manual or automated, that generates or uses plasma for cutting, welding, spraying, or marking operations, among others. Accordingly, the specific reference to plasma arc cutting torches or plasma arc torches herein shall not be construed as limiting the scope of the present invention.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiments is merely exemplary in nature and is in no way intended to limit the invention, its application, or uses.

Figure 1:
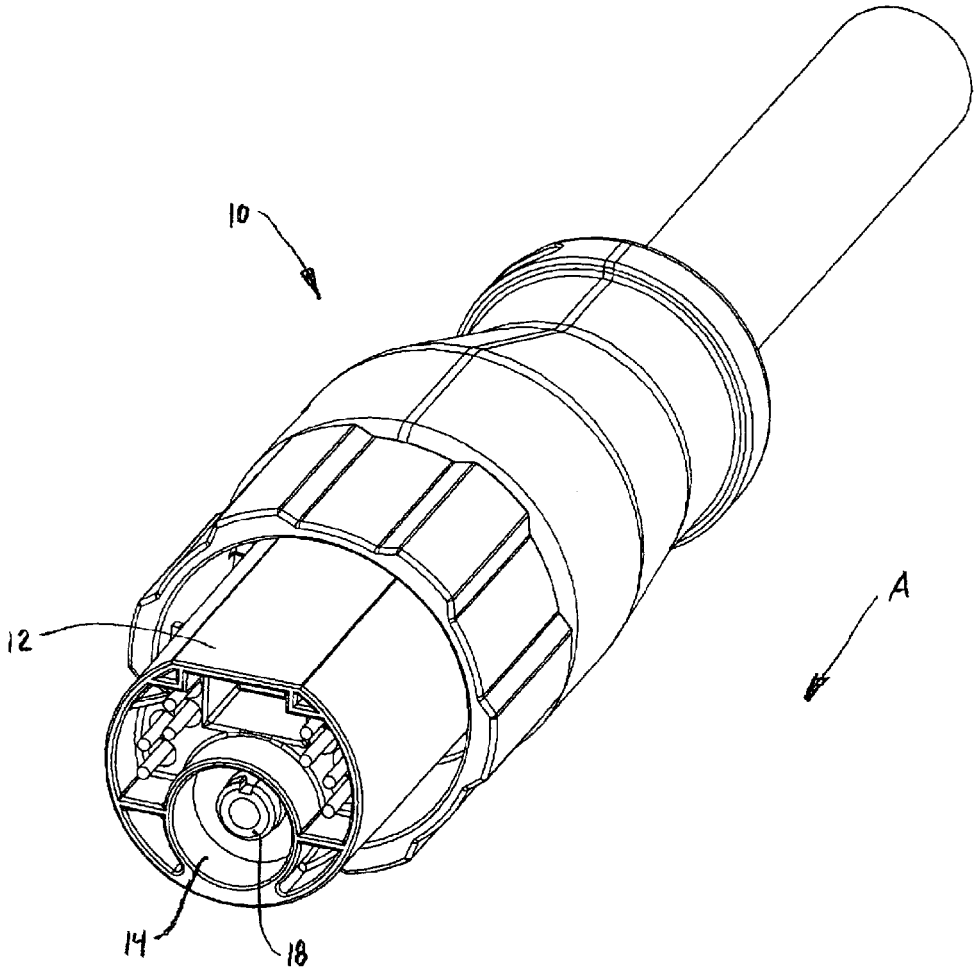
FIG. 1 is a perspective view of an embodiment of a negative lead gas carrying pin secured within a plug housing of a connector between a torch lead and a plasma arc power supply constructed according to the principles of the present invention.
Figure 2:
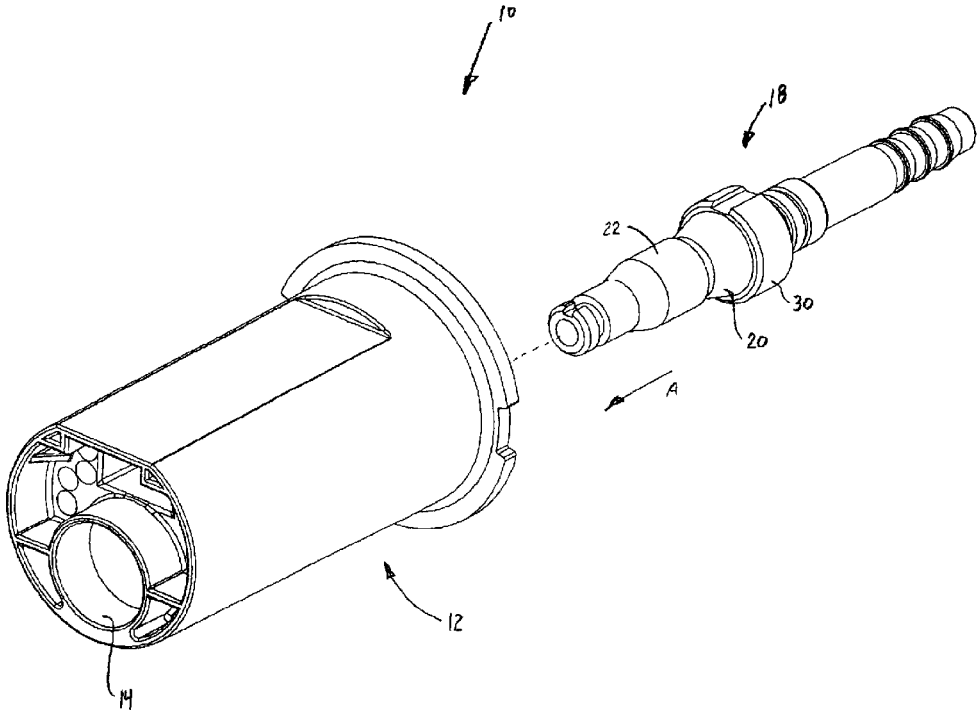
FIG. 2 is an exploded view of an embodiment of a negative lead gas carrying pin and a plug housing of a connector between a torch lead and a plasma arc power supply constructed according to the principles of the present invention.
Figure 3:
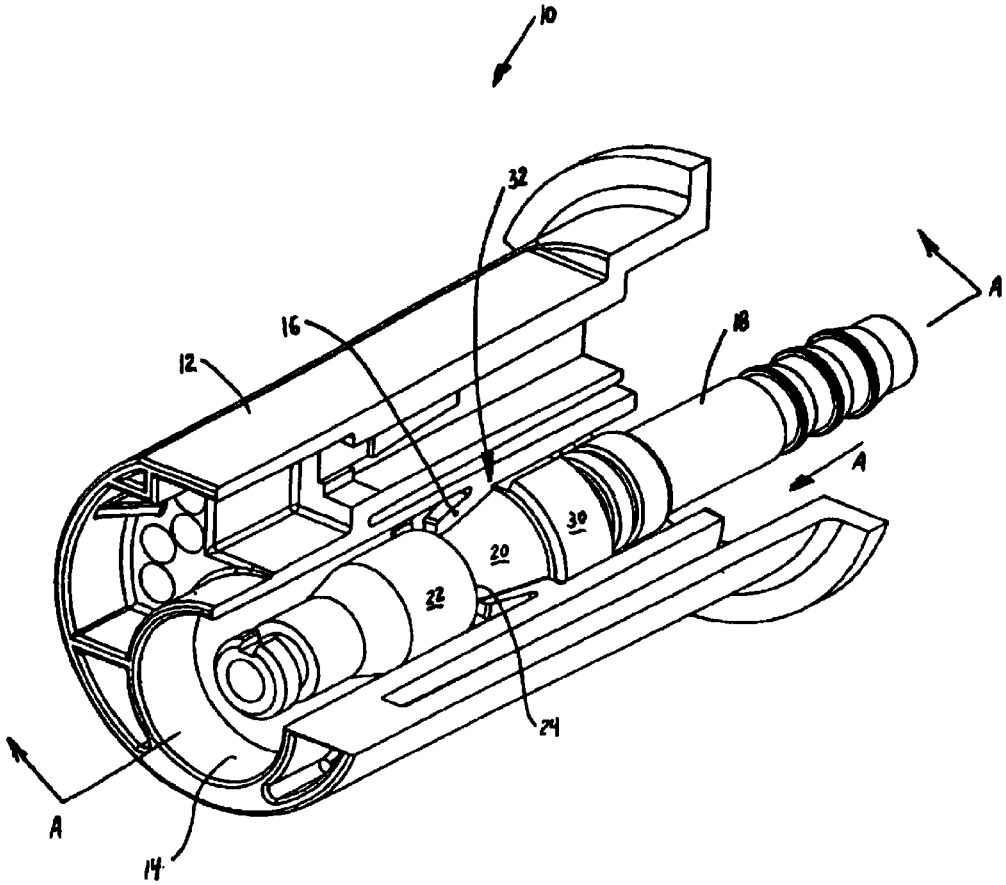
FIG. 3 is a cutaway view of an embodiment of a negative lead gas carrying pin secured within a plug housing of a connector between a torch lead and a plasma arc power supply constructed according to the principles of the present invention.
Figure 4:
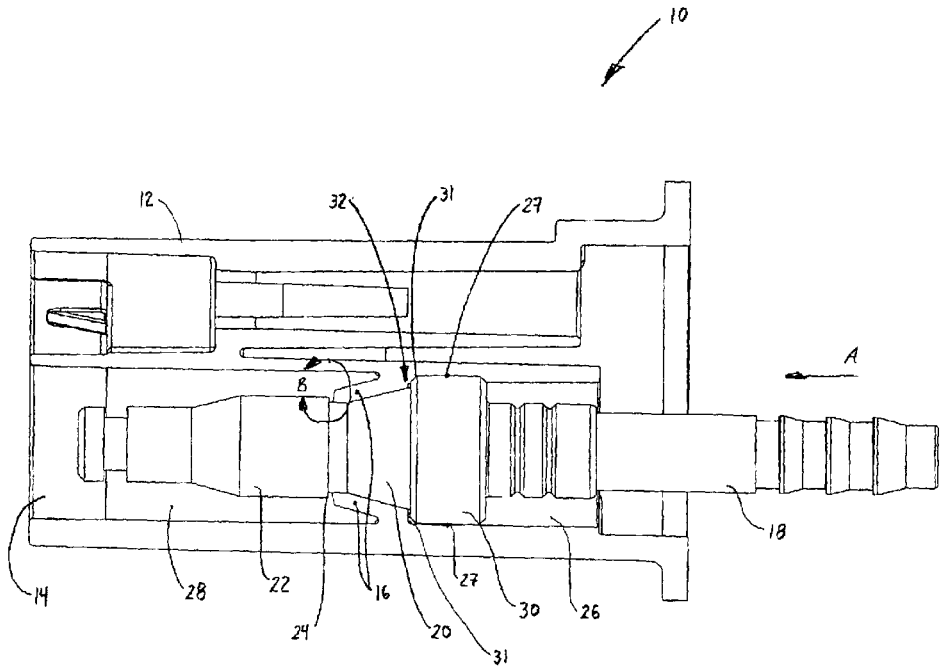
FIG. 4 is a cross-sectional view, taken along plane A—A of FIG. 3, of an embodiment of a negative lead gas carrying pin secured within a plug housing of a connector between a torch lead and a plasma arc power supply constructed according to the principles of the present invention.

Referring to the drawings, a connector for use in a plasma arc cutting apparatus according to one preferred form of the present invention is illustrated and generally indicated by reference numeral 10 in FIGS. 1 through 4. As shown, the connector 10 comprises a housing 12 that defines a hollow internal channel 14, and a plurality of locking fingers 16, (as best shown in FIGS. 3 and 4), disposed within the hollow internal channel 14. Further, the connector 10 comprises a pin 18, which may be a negative lead gas carrying pin in a plasma arc cutting apparatus. The pin 18 defines a tapered portion 20 and a first collar 22 with a shoulder 24 disposed therebetween as shown. Accordingly, the locking fingers 16 engage the tapered portion 20 and the shoulder 24 to secure pin 18 within the housing 12 as the pin 18 is inserted into the housing 12 in the direction of arrow A, such that the connection is tamper resistant. Furthermore, although a plurality of locking fingers 16 are shown in one form of the present invention, a single locking finger may alternately be employed to secure the pin 18 within the housing 12.

As shown, the locking fingers 16 slope inwardly and distally, and the shoulder 24 faces proximally when disposed within the hollow internal channel 14. Accordingly, the shoulder 24 engages distal ends of the locking fingers 16 such that the pin 18 is retained within the housing 12 against proximal movement. As further shown, the hollow internal channel 14 and the pin 18 extend distally beyond the engagement between the locking fingers 16 and the pin 18, to define a relatively long, restricted space between the pin 18 and the hollow internal channel 14 that restricts access to the locking fingers 16.

As further shown in FIG. 4, the hollow internal channel 14 also comprises a first portion 26 and a second portion 28, which are separated by the locking fingers 16, wherein the pin 18 is disposed when fully engaged within the housing 12. Further, the pin 18 also defines a second collar 30 disposed at a base end 32 of the tapered portion 20. Accordingly, the second collar 30 blocks access to the locking fingers 16 by engaging the first portion 26 of the hollow internal channel 14 along interface 27 such that the locking fingers 16 cannot be accessed to disengage the pin 18. When fully engaged, therefore, the first collar 22 is disposed within the second portion 28 of the hollow internal channel 14, and the second collar 30 engages the first portion 26 of the hollow internal channel 14 along the interface 27 to block access to the locking fingers 16 through the first portion 26. Moreover, the pin 18 is recessed within the second portion 28 of the hollow internal channel 14 to further limit and maintain a tamper resistant pin connection.

To install the pin 18 within the housing 12, the pin 18 is first inserted through the first portion 26 of the hollow internal channel 14 until the locking fingers 16 are engaged. As the pin 18 is further inserted into the housing 12 in the direction of arrow A, the locking fingers 16 expand radially outward as the first collar 22 successively engages the locking fingers 16. After the first collar 22 passes beyond the locking fingers 16, the locking fingers 16 flex back radially inward to engage the shoulder 24 and the tapered portion 20. As a result, the pin 18 is secured within the housing 12 such that a tamper resistant pin connection is provided.

Accordingly, if the pin 18 were pulled in a direction opposite to that of arrow A, the shoulder 24 abuts the locking fingers 16, and thus the pin 18 is prevented from movement in such direction. Furthermore, if the pin 18 were continually pushed in the direction of arrow A, the second collar 30 abuts a hollow internal channel shoulder 31 formed between the locking fingers 16 and the hollow internal channel 14 as shown. Accordingly, the pin 18 is prevented from further moving in the direction of arrow A as the second collar 30 abuts the hollow internal channel shoulder 31.

Figure 5:
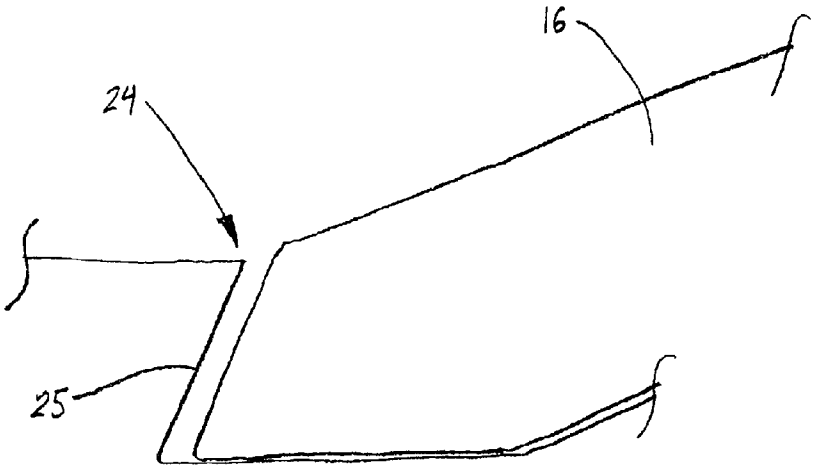
FIG. 5 is an enlarged view, taken within arrow B of FIG. 4, of an embodiment of a shoulder constructed according to the principles of the present invention.

As shown in FIG. 5, the shoulder 24 preferably comprises an undercut 25 as shown. Accordingly, the undercut 25 provides additional contact area for the locking fingers 16, which more firmly secures the pin 18 within the housing 12. Preferably, the undercut 25 is integrally formed with the housing 12. Alternately, the undercut 25 may be post formed into the housing 12, for example by machining, among other methods commonly known in the art.

Figure 6:
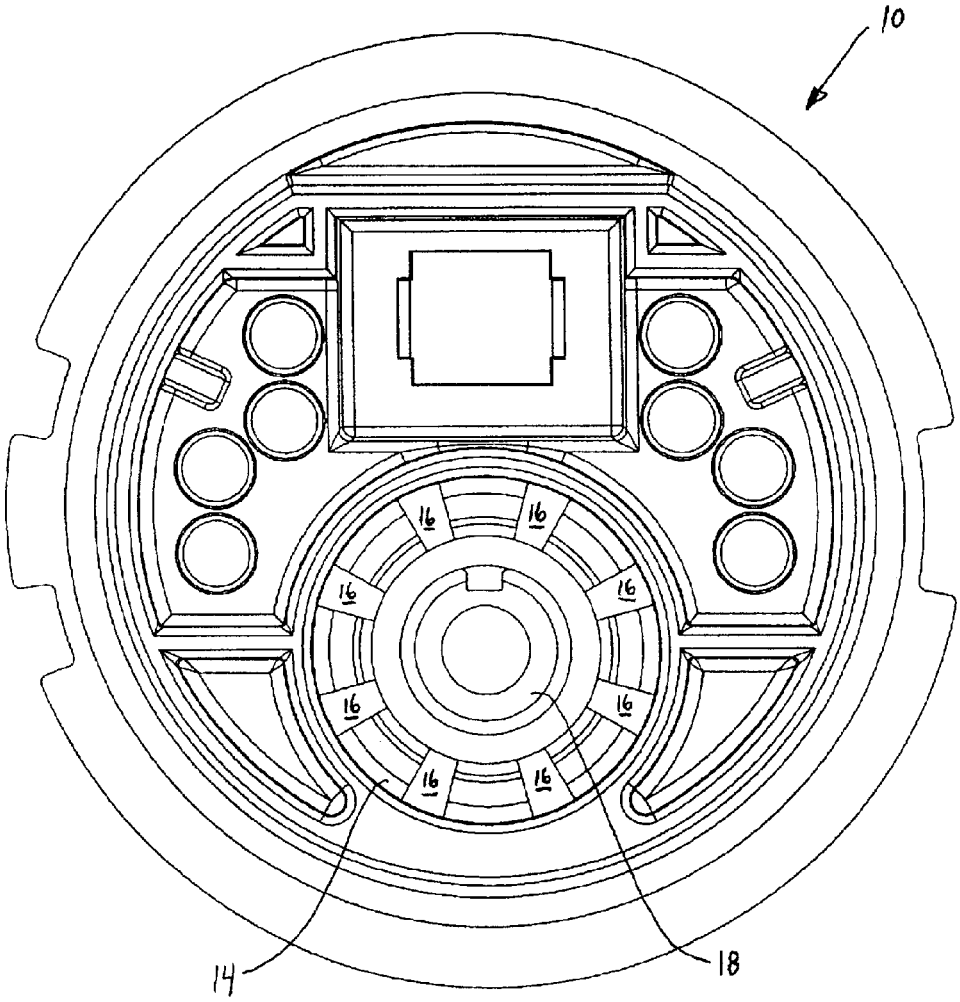
FIG. 6 is an end view of an embodiment of a housing with locking fingers constructed according to the principles of the present invention.

Referring now to FIG. 6, a total of eight (8) locking fingers 16 are employed in one preferred form of the present invention. As shown, the locking fingers 16 are preferably evenly spaced around the hollow internal channel 14. Further, the locking fingers 16 are preferably integrally formed within the hollow internal channel 14 such that the housing 12 is a single one-piece component. The preferred material for the housing 12 is a fiber-reinforced nylon, which is non-conductive, lightweight, flexible, and durable. However, other materials commonly known in the art having similar properties may also be employed in accordance with the teachings of the present invention.

Preferably, the housing 12 is a plug housing located on a torch lead side of a connection between a torch lead and the power supply (not shown), although other housings within a plasma arc apparatus, such as a socket housing, may also provide a connector in accordance with the teachings of the present invention. Further, although the housing 12 engages a negative lead gas carrying pin, other pins commonly known in the art may also be employed such as pins that carry only electric current rather than both gas flow and electric current as with a preferred form of the present invention. Moreover, additional pins that conduct other fluids such as cooling fluids, e.g., water, may also be employed in accordance with the teachings of the present invention.

Preferably, the pin 18 as a negative lead gas carrying pin is a conductive material such as brass in one form of the present invention that is used with a plasma arc cutting apparatus. However, it shall be understood by those skilled in the art that other material types for the pin 18 may also be employed according to specific application requirements.

Accordingly, a tamper resistant pin connection is provided by the teachings of the present invention, wherein a pin is secured within a housing to provide a tamper resistant connection, such that an improper pin may not be replaced within the housing. As a result, a plasma arc torch in one form of the present invention is safer to operate since the negative lead gas carrying pin is tamper resistant.

The description of the invention is merely exemplary in nature and, thus, variations that do not depart from the substance of the invention are intended to be within the scope of the invention. For example, more or less than eight (8) locking fingers within the hollow internal channel of the housing may be employed in accordance with the teachings of the present invention. Further, the housing and pin may define a cross-sectional geometry other than the circular shape as described herein. Moreover, the connector, housing, and pin in accordance with the various embodiments as described herein may be employed in devices other than a plasma arc cutting apparatus. Such variations are not to be regarded as a departure from the spirit and scope of the invention.

What is claimed is:

1. A connector for use in a plasma arc apparatus comprising:

a housing defining a hollow internal channel, the hollow internal channel comprising a shoulder disposed between a first portion and a second portion of the hollow internal channel;

at least one locking finger disposed within the hollow internal channel and disposed distally from the shoulder, wherein the shoulder, the locking finger, and the housing form a one-piece construction; and a pin comprising:

a first collar with a shoulder disposed thereon; and a second collar disposed proximally from the first collar, wherein the locking linger engages the pin shoulder to prevent movement of the pin in a proximal direction and the housing shoulder engages the second collar of the pin to prevent movement of the pin in a distal direction without a member disposed between the locking finger and the housing, and the second collar of the pin blocks access to the locking finger through the first portion of the hollow internal channel; and wherein the one-piece construction of the housing, the locking finger, and the shoulder prevent the pin from being removed without destruction of the connector.

2. The connector of claim 1, wherein the pin further comprises a tapered portion such that the pin shoulder is disposed between the first collar and the tapered portion.

3. The connector of claim 1, wherein the housing comprises a fiber-reinforced nylon material.

4. The connector of claim 1 further comprising eight locking fingers evenly spaced around the hollow internal channel.

5. The connector of claim 1, wherein the pin is recessed within the second portion of the hollow internal channel.

6. The connector of claim 1, wherein the pin is a negative lead gas carrying pin of the plasma arc cutting apparatus.

7. The connector of claim 1, wherein the pin comprises a brass material.

8. A connector for use in a plasma arc apparatus comprising:

a plug housing defining a hollow internal channel with a first portion and a second portion;

a plurality of locking fingers disposed within the hollow internal channel between the first portion and the second portion, the locking fingers and the plug housing forming a one-piece construction; and a negative lead gas carrying pin comprising a first collar with a shoulder disposed thereon, and a second collar disposed proximally from the first collar, wherein the locking fingers engage the shoulder to prevent movement of the negative lead gas carrying pin in a proximal direction, the housing engages the second collar to prevent movement of the negative lead gas carrying pin in a distal direction, and the second collar of the negative lead gas carrying pin blocks access to the locking fingers through the first portion of the hollow internal channel.

9. The connector of claim 8, wherein the plug housing comprises a fiber-reinforced nylon material.

10. The connector of claim 8, wherein the plurality of locking fingers comprise eight looking fingers evenly spaced around the hollow internal channel.

11. The connector of claim 8, wherein the pin is recessed within the second portion of the hollow internal channel.

12. The connector of claim 8, wherein the negative gas carrying pin comprises a brass material.

13. A connector comprising:

a housing defining a hollow internal channel, the hollow internal channel comprising a first portion, a second portion, and a shoulder disposed between the first portion and the second portion;

at least one locking finger disposed within the hollow internal channel and disposed distally from the shoulder, the locking finger, the shoulder, and the housing forming a one-piece construction; and a pin defining a first collar with a shoulder disposed thereon and a second collar disposed proximally from the first collar, wherein the second collar slidably blocks access to the locking finger through the first portion of the hollow internal channel, the pin is recessed within the second portion of the hollow internal channel, the locking finger engages the pin shoulder to prevent movement of the pin in a proximal direction, and the housing shoulder engages the second collar to prevent movement of the pin in a distal direction.

14. The connector of claim 13, wherein the housing comprises a fiber-reinforced nylon material.

15. The connector of claim 13 further comprising eight locking fingers evenly spaced around the hollow internal channel.

16. A housing for use in connecting a pin in a plasma arc apparatus comprising:

a hollow internal channel comprising a shoulder; and at least one locking finger disposed within the hollow internal channel and disposed distally from the shoulder, the shoulder, the locking finger, and the housing forming a one-piece construction, wherein the locking finger prevents movement of the pin in a proximal direction, and the shoulder prevents movement of the pin in a distal direction.

17. The housing of claim 16 further comprising eight locking fingers evenly spaced around the hollow internal channel.

18. The connector of claim 16, wherein the housing comprises a fiber-reinforced nylon material.

19. In a connector for making a connection in a plasma arc apparatus to provide fluid and electric power, the connector having a housing mounting a pin for conducting fluid and electric power, the improvement comprising:

a tamper resistant connection between the housing and the pin comprising:

a first collar;

a second collar disposed proximally from the first collar; and a hollow internal channel within the housing to receive the pin, the hollow internal channel comprising a plurality of locking fingers and a shoulder disposed proximally from the locking fingers, the locking fingers, the shoulder, and the housing forming a one-piece construction, wherein the locking fingers engage the first collar to secure the pin in a proximal direction and the housing shoulder engages the second collar to secure the pin in a distal direction.

20. The connector of claim 19, wherein at least a portion of the pin proximal to the fingers is sized to closely conform to the hollow internal channel, to restrict access to the locking fingers.

21. The connector of claim 19, wherein the locking fingers slope inwardly and distally, and wherein the shoulder faces proximally when disposed in the hollow internal channel to engage distal ends of the locking fingers and retain the pin against proximal movement.

22. The connector of claim 19, wherein the hollow internal channel and the pin extend distally beyond the engagement between the locking fingers and the pin, to define a relatively long, restricted space between the pin and the hollow internal channel that restricts access to the fingers.

23. A connector for use in a plasma arc apparatus comprising:

a housing defining a hollow internal channel;

at least one locking finger disposed within the hollow internal channel, the locking finger and the housing forming a one-piece construction; and a pin disposed within the housing and comprising:

a first collar with a shoulder disposed thereon; and a second collar disposed proximally from the first collar, wherein the locking finger engages the shoulder and the second collar engages the housing such that the pin cannot be removed without destruction of the connector.

* * * * *

UNITED STATES PATENT AND TRADEMARK OFFICE

CERTIFICATE OF CORRECTION

PATENT NO. : 6,773,304 B2
DATED : August 10, 2004
INVENTOR(S) : Christopher J. Conway et al.

It is certified that error appears in the above-identified patent and that said Letters Patent is hereby corrected as shown below:

Column 5,
Line 47, replace “linger” with -- finger --

Signed and Sealed this

Twenty-fifth Day of January, 2005

JON W. DUDAS
*Director of the United States Patent and Trademark Office*